United States Patent [19]

Kost et al.

[11] 4,420,287

[45] Dec. 13, 1983

[54] GRIPPER FEED AND GRIPPER RESILIENCE CYLINDERS ON FORGING MANIPULATORS

[75] Inventors: Erwin Kost, Meerbusch; Werner Folta, Mettmann, both of Fed. Rep. of Germany

[73] Assignee: SMS Schloemann-Siemag Aktiengesellschaft, Dusseldorf, Fed. Rep. of Germany

[21] Appl. No.: 260,770

[22] Filed: May 5, 1981

[30] Foreign Application Priority Data

May 24, 1980 [DE] Fed. Rep. of Germany ..... 3019971

[51] Int. Cl.[3] ..... B21J 13/10

[52] U.S. Cl. ..... 414/729; 414/719; 414/749; 414/917; 414/4; 92/146

[58] Field of Search ..... 414/4, 749, 751, 917, 414/620, 729, 719; 92/146, 165 R; 72/420

[56] References Cited

U.S. PATENT DOCUMENTS

| | | | |
|---|---|---|---|
| 2,238,424 | 4/1941 | McQuade | 92/146 |
| 2,821,264 | 1/1958 | Ulinski | 92/146 |
| 3,370,452 | 2/1968 | Sack et al. | 72/420 |
| 3,498,490 | 3/1970 | Schussler | 414/620 |
| 3,543,956 | 12/1970 | Furuno | 414/917 X |

FOREIGN PATENT DOCUMENTS

| | | | |
|---|---|---|---|
| 2731792 | 2/1979 | Fed. Rep. of Germany | 414/917 |

*Primary Examiner*—Robert J. Spar
*Assistant Examiner*—Terrance L. Siemens
*Attorney, Agent, or Firm*—Holman & Stern

[57] ABSTRACT

A forging manipulator has a mobile truck on which a gripper support is suspended by articulated linkages. To move the gripper support relative to the truck, and to provide cushioning of the gripper support, the gripper support is coupled to the truck by hydraulic cylinder assemblies. Each cylinder assembly includes three cylinders placed one above another with the piston of a middle cylinder connected to the truck and with the pistons of the outer cylinders connected to each other and to the gripper support.

6 Claims, 6 Drawing Figures

II
II
1
1
2
3
4
5
6
6
7
7
8
9
10
11
11
12
13
14
14
15
15
16
16
16
17
17
17
18
19
19a
19b
19b
20
21
21
21a
21a
21b
21b
22
23
24
25
26
27
28
28
29

I
I
4
11
13
14
15
16
16
17
17
20
21
24
27
28
19b

GRIPPER FEED AND GRIPPER RESILIENCE CYLINDERS ON FORGING MANIPULATORS

BACKGROUND OF THE INVENTION

1. Field of the Invention

The invention relates to forging manipulators of the kind comprising a gripper support and a manipulator truck, the gripper support being pivotably supported by means of a front and a rear linkage on the frame of the manipulator truck, which advantageously reciprocates continuously in the direction of a forging press, and being controllably axially movable in the forward and reverse direction in relation to the manipulator truck from a middle position by hydraulic piston-cylinder units pivotably mounted on the one hand on the frame of the manipulator truck and on the other hand on the gripper support.

2. Description of the Prior Art

Manipulators with a controlled gripper feed motion are used to achieve large and rapid feed motions of the workpiece in automatically integrated forging operations of a forging press and a forging manipulator. That is to say, grippers supporting the workpiece are rapidly advanced during the press return stroke when the workpiece is released, and are retained relative to the travel of the manipulator truck during the forging of press forming operation, or the gripper support is controlled so that a speed of equal magnitude but opposite to the speed of the manipulator truck is imparted to said gripper support which remains fixed in space relative to the ground. In this method of operation the manipulator truck traverses at a constant speed. The feed motion and relative operating motion of the gripper support is provided by hydraulic cylinders disposed between the gripper support and the manipulator truck.

Complicated free form forging operations require separate and manual operation of press and manipulator, and a horizontal gripper support resilience or cushioning in place of the controlled gripper support feed motion. Such axial resilience of the gripper support is provided by connection of the hydraulic cylinders to hydraulic accumulators.

The hydraulic cylinders are commonly double cylinders, disposed one behind the other and comprising a single cylinder casing which is divided in the middle of the longitudinal axis of the cylinder by means of a bulkhead (see U.S. Pat. No. 3,370,452). The pistons, usually double acting, have their principal piston surface or crown oriented towards the bulkhead or towards the cylinder base of the cylinder concerned. The annular surfaces of the piston adjoining the piston rods are outwardly oriented. The ends of the respective piston rods are pivotably mounted on the one hand on the manipulator truck and on the other hand on the gripper support. In the forward direction of movement of the manipulator truck the rear piston is hydraulically supported by the cylinder casing and in the reverse direction of movement of the manipulator truck it is the front piston which is thus supported.

Given suitable hydraulic control, this construction permits controlled gripper support feed motion, i.e. the return motion, into the starting position, of the gripper support relative to the manipulator truck after the forging operation of the forging stroke of the press, and also permits operation to provide horizontal gripper spring suspension when hydraulic fluid is displaced from the cylinder into the pressure accumulator which charges the said cylinder.

Howwever, the long structural length and the associated risk of buckling which arises with long stroke lengths, and the arrangement of the cylinder or cylinders in the forging manipulator itself, were found to be detrimental.

Some examples of mounting known hydraulic cylinders will be explained below:

1. Arrangement of the cylinder on the end of the gripper support results in the following disadvantages:
   a. A large pivoting angle between the fixed rear suspension point on the manipulator truck and that of the gripper support owing to the required angle of inclination of the latter, also that caused by parallel motion of the gripper support and parallel displacement perpendicularly to its longitudinal axis,
   b. Power is transmitted over the entire gripper support casing,
   c. A large amount of space is required between the gripper support end and the cross-member of the manipulator truck frame.
2. The lateral arrangement of the cylinder pair on the rear gripper support suspension results in the following disadvantages:
   a. A large, although improved, pivoting angle, caused by the necessary inclination of the gripper support as well as during the parallel stroke,
   b. Power in this case is also transmitted via the entire support casing,
   c. Only insignificantly improved space requirements between the gripper support end and the cross-member of the manipulator truck frame.
3. Lateral arrangement of the cylinder pair, on the one hand on the front gripper support member and on the other hand on the side member or frame of the manipulator truck in an arrangement in which the piston-cylinder units are not parallel with the axis of the gripper support:

Advantages a. An advantageous small pivoting angle when the gripper support performs its parallel stroke,
b. A short power transmission distance in the gripper support casing.

Disadvantages a. A different position of the individual cylinders with respect to each other when the gripper support is laterally displaced parallel with its longitudinal axis. Problems also arise with the controlled feed motion of the gripper and gripper support.
b. Lateral guidance of the gripper support by the frame of the manipulator truck is not possible. The quality of forging is therefore impaired.

4. Lateral arrangement of the cylinder pair on the right and left of the gripper support outside the leading gripper support suspension but parallel with the gripper support end frame:

Advantages a. Advantageous pivoting angle during the parallel stoke of the gripper support.
b. A short power transmission distance in the gripper support casing.
c. Lateral guidance of the gripper support by the frame of the manipulator truck is ensured.

Disadvantages a. An unfavorable bending moment along the front support axis of the gripper support.
b. A broader manipulator frame and center distance between the rails is required.

5. Lateral arrangement of the cylinder pair on the right and left of the gripper support, directly on the front gripper support suspension and parallel with the longitudinal axis of the gripper support:

Advantages a. An advantageous pivoting angle when the gripper support performs its parallel stroke.
b. A short power transmission distance in the support casing.
c. Lateral guidance of the gripper support on the frame of the manipulator truck is ensured.
d. Power transmission to the front support axis of the gripper support is advantageous.

Disadvantages a. A longer gripper support is required to arrange the cylinder pairs between the front and rear support axis of the gripper support.
b. A longer side is required for the frame of the manipulator truck to accomodate the gripper support.

BRIEF SUMMARY OF THE INVENTION

The object of the invention is to achieve the advantages of known gripper support mounting and operating systems while avoiding the disadvantages, combined with the demand for a more compact, stiffer and more advantageous arrangement of the gripper feed and resilience cylinders between the gripper support and the frame of the manipulator truck.

The present invention provides a forging manipulator comprising a manipulator truck, a gripper support, a front linkage which pivotably supports the gripper support on the truck, and hydraulic cylinder means mounted to act between the truck and the gripper support for providing cushioning and effecting longitudinal relative movement of the support on the truck and in which the hydraulic cylinder means comprise an assembly of three generally horizontal cylinders in vertical spaced relationship, respective pistons slidable in said cylinders, and respective piston rods carrying said pistons, the piston rods of the two outer cylinders of the three cylinders being interconnected and being pivotably coupled to one of the truck and the gripper support, and the piston rod of the middle cylinder of the three being pivotably coupled to the other of the truck and the gripper support.

Also according to the invention the device for effecting the gripper feed motion and gripper return stoke as well as the device for providing axial resilience in both directions comprises three approximately horizontally extending hydraulic cylinders which are interconnected and disposed in spaced vertical array and piston rods which are protected against buckling. The piston rods of the outer cylinders are interconnected, and the piston areas of the outer cylinders are in a specific ratio to the piston crown area of the middle cylinder depending on the selected method of control.

This achieves a very compact arrangement of the interconnected cylinders which were herebefore arranged one behind the other and are now arranged in vertical spaced relationship. The structural length is reduced by more than one third compared with that of known constructions. This also reduces the buckling length of the piston rods in these cylinders because the cylinders and the piston rods can be made shorter.

Short and direct power transmission to the gripper support and frame is now obtained. Furthermore, the gripper feed functions and the gripper resilience functions can be performed with the same cylinder. The principal dimensions of the manipulator are reduced by shortening of the gripper support and of the lateral frame of the manipulator truck and costs are thus reduced. Furthermore, th feed functions and resilience functions are retained in all positions of movement of the gripper support.

The middle cylinder of this construction according to the invention corresponds to the previous cylinder construction. Parallel above and below the middle cylinder there are smaller outer cylinders whose piston rods are interconnected.

Preferably the piston rod of the middle hydraulic cylinder is guided by a cross-member connected thereto, by means of guide rods mounted on the two cylinder ends of the outer cylinders, and the two piston rods of the outer cylinders are fixed rigidly in a cross-member.

The additional guidance provided by this arrangement offers further security for the piston rods against buckling when performing long strokes and when cushioning shocks.

BRIEF DESCRIPTION OF THE DRAWINGS

One example of the invention will be explained hereinbelow by reference to the accompanying drawings, in which.

DETAILED DESCRIPTION

Figure 1:
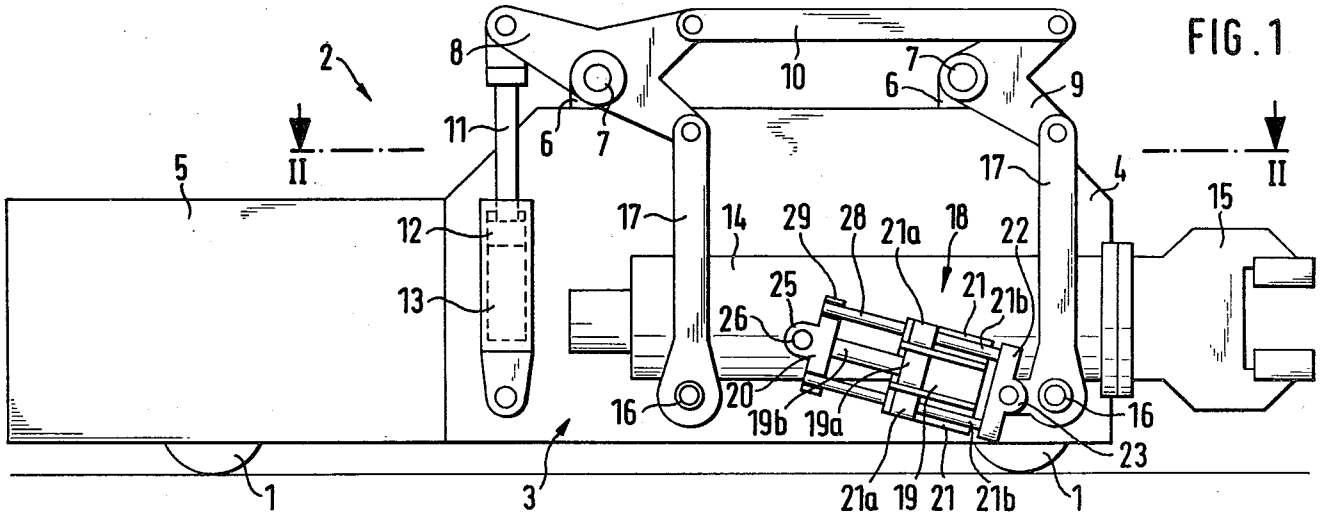
FIG. 1 is a side elevational view, taken along the line I—I of FIG. 2, of the forging manipulator of this invention.
Figure 2:
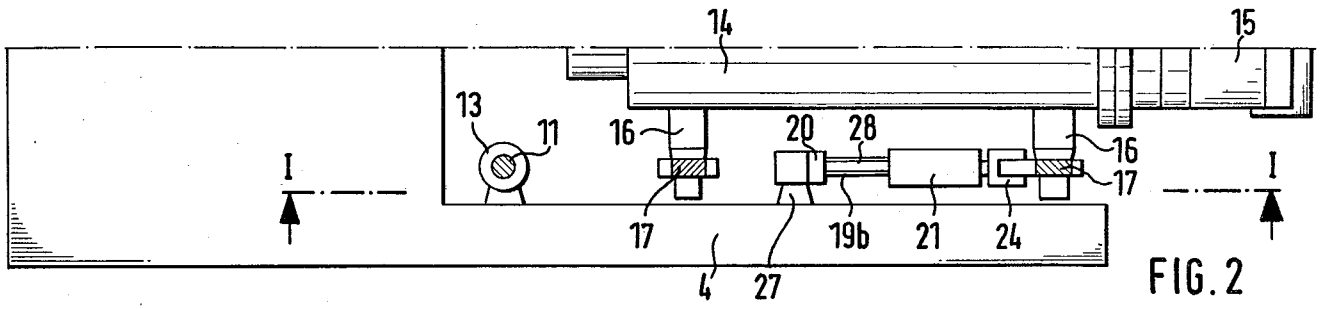
FIG. 2 is a partly cross-sectional plan view of the forging manipulator taken along the line II—II of FIG. 1.

The illustrated forging manipulator 2, adapted to move forwards and backwards on wheels 1, comprises a manipulator truck 3 having at its forward end a side frame or side cheeks 4, and a rear part 5 which carries hydraulic pumps, hydraulic fluid tanks, hydraulic accumulators 30 (FIG. 6), valves and the like which are not shown. Front and rear supports 6 for front and rear rotatably mounted cross-shafts 7 are provided on the side members 4 disposed on the right and left of the truck axis. A three-armed bell crank 8 is mounted non-rotatably to each end of the rear cross-shaft 7 and a two-armed bell crank 9 is disposed on each end of the front cross-shaft 7. The front bell cranks 9 are pivotably connected via horizontal tie rods 10 to the rear bell cranks 8 to form a parallel linkage. A piston rod 11, pivoted to a third arm of the rear bell cranks 8, is attached to a piston 12 which slides in a hydraulic lifting cylinder 13 which is pivotally mounted on the side cheeks of the manipulator truck 3.

A gripper support 14 with gripper 15 is pivotably suspended, via support shafts 16 at its front and rear parts and front and rear vertical tie rods 17 from the front bell cranks 9 and the rear bell cranks 8.

A gripper feed and resilience cylinder assembly 18 is disposed on the right and left hand sides of the gripper support 14. Each cylinder assembly 18 comprises a middle cylinder 19 with a piston **19*a* and a piston rod 19*b*, the end of which is fixedly connected to a cross-member 20, and two outer cylinders 21 with pistons 21*a* and piston rods 21*b*. The piston rods 21*b* are tightly fixed to a common cross-member 22**. All three cylinders are fixedly connected to each other and form a movable cylinder assembly. The cylinders are generally arranged in vertical spaced relationship with their longitudinal axes horizontal.

Figure 6:
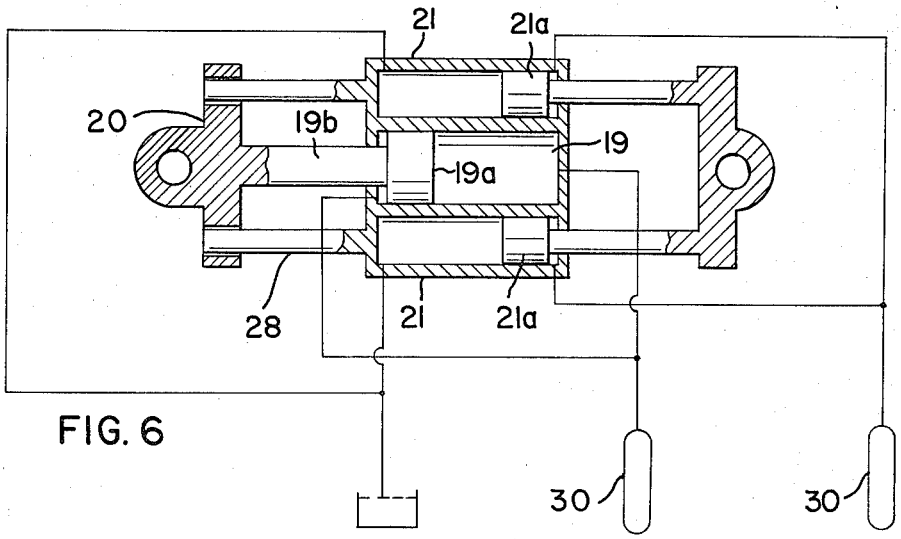
FIG. 6 is a cross-sectional schematic view similar to FIG. 5, and showing additional cushioning means.

To provide axial resilience or cushioning of the gripper support, the cylinders 19, 21 are connected to hydraulic accumulators 30 as shown in FIG. 6 and provided with suitable check valves in a manner well known to those skilled in the art.

The cross-member 22, connected to the two outer piston rods **21*b*, is pivotably connected to the bottom end of the front tie rod 17 at the height of the front support shaft 16, by means of a bearing pin 24 pivotably mounted at its ends in eyes 23** provided on the cross-member.

The cross-member 20, mounted on the piston rod **19*b* of the middle cylinder 19, is pivotably connected by an eye 25, provided on said cross-member, and bearing pin 26, to stud 27 mounted on the side frame or side cheeks 4 of the manipulator truck 3**.

Longitudinal guide rods 28 which extend through guide bores 29 in the cross-member 20 are mounted on the cylinder bases of the two outer cylinders 21.

Figure 3:
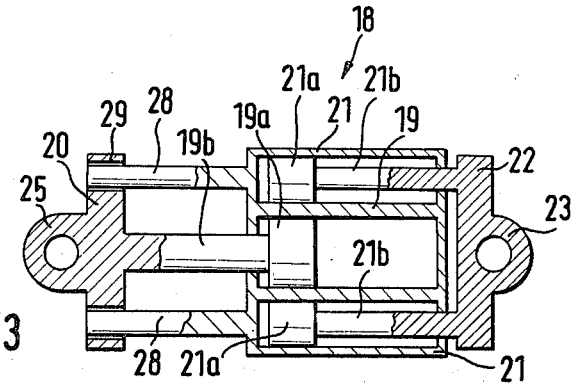
FIG. 3 is a vertical cross-sectional view showing the gripper feed and cushioning cylinders of the forging manipulator of FIG. 1 in the basic position.

The operation of the cylinder assemblies 18 to provide gripper feed and gripper resilience is as follows, as already briefly mentioned:

FIG. 3 shows the so-called basic or middle position of the cylinders and therefore of the gripper support 14 relative to the manipulator truck 3.

Continuous forward travel of the manipulator truck 3 to the right and simultaneous forging of the workpiece, which is held in the grippers 15 of the gripper support 16 but is not shown, is accompanied by a so-called relative stroke of the middle cylinder 19 or piston **19*a*, a corresponding control function being performed. During the forward motion of the manipulator truck 3 the annular surfaces of the pistons 21*a* are hydraulically biased so that no relative motion takes place between the piston 21*a* and the cylinders 21**.

Figure 4:
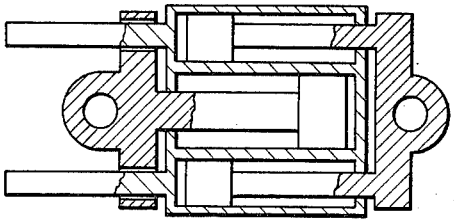
FIG. 4 is a view similar to FIG. 3 but after completion of the forging stroke of a press when the manipulator truck is advanced.

The completion of the forging operation, with the gripper support 14 deflected from the basic or middle position, is indicated in FIG. 4. Here, all the pistons **19*a*, 21*a* are situated against the cylinder bases and form a very compact system of short structural length. The so-called "gripper shot", in which the cylinder 19 is charged on the crown of the piston 19*a*, causes the gripper support 14** to return to its basic position when the workpiece is released by the forging press, which is not shown.

Figure 5:
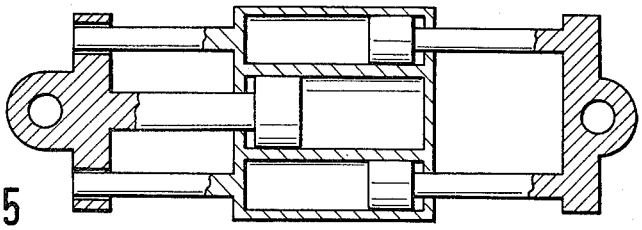
FIG. 5 is a view similar to FIGS. 3 and 4 but showing the position of the cylinders with the reversing manipulator truck at the end of the forging stroke of the press.

FIG. 5 illustrates the situation at the end of the forging operation when the manipulator truck 3 returns. The middle piston **19*a* is locked to the cylinder 19 during the return travel, owing to the crown of said piston being hydraulically biased. The two outer cylinders 21 will then perform the function of the gripper feed motion or gripper resilience motion. In the phase illustrated in FIG. 5 at the end of the forging operation the piston rods of all three pistons 19*a* and 21*a* are shown fully extended. This is when the risk of buckling is greatest. Owing to the short construction by arranging the cylinders in vertical spaced relationship, and also because of the additional guidance for the piston rods 19*b* provided via the cross-member 20 on the guide rods 28 and the rigid fixing of the two piston rods 21*b* an the cross member 22** and consequent stiffness of the piston rod/cross-member assembly, the risk of buckling of the cylinder system is practically eliminated.

We claim:

1. In a forging manipulator including a manipulator truck, a gripper support, a front suspension link and a rear suspension link which pivotably support the gripper support for relative longitudinal movement on the truck, and hydraulic cylinder means mounted to act between the truck and the gripper support for providing cushioning for longitudinal relative movement of said gripper support with respect to said truck, the improvement wherein the hydraulic cylinder means comprises a double acting movable assembly of three parallel spaced cylinders to form said assembly with a separate and independent middle cylinder and two separate and independent outer cylinders, respective pistons slidable in said cylinders, and respective separate and independent piston rods connected to said pistons, means to interconnect the piston rods of said two outer cylinders, means to pivotably connect said interconnecting means to one of the truck and the gripper support, and means to connect the piston rod of said middle cylinder pivotably to the other of the truck and the gripper support, so that when said middle piston and cylinder are operated during forward motion of the manipulator into forging position to produce a relative stroke of the middle piston and piston rod with respect to said middle cylinder, said outer interconnected piston rods and pistons are hydraulically biased in their retracted position to prevent relative motion between them and said respective outer cylinders, and when said outer piston rods and pistons are operated to produce relative motion thereof with respect to their outer cylinders toward their fully extended position, said middle piston is hydraulically biased in its fully extended position.

2. A forging manipulator according to claim 1 wherein said means to connect said middle cylinder piston rod to the truck or gripper support comprises a cross-member provided on the piston rod of the middle cylinder, and guide rods extending longitudinally from said outer cylinders and in sliding and guiding engagement with said cross-member.

3. In a forging manipulator including a gripper support, a manipulator truck, a front and a rear suspension linkage whereby the gripper support is pivotably supported on the frame of the manipulator truck, for relative longitudinal movement with respect thereto, and means for controlling forward and reverse axial movement of the gripper support in relation to the manipulator truck from a middle position including hydraulic piston-cylinder units pivotably connected to the frame of the manipulator truck and the gripper support and providing axial resilience for said forward and reverse movement, the improvement wherein said means for controlling gripper support forward and reverse motion and providing axial resilience in both directions comprises three hydraulic cylinders arranged in substantially vertically spaced relationship with respect to each other with their longitudinal axes approximately horizontal, said cylinders being connected to form a movable, double acting assembly, respective piston rods for said pistons, the piston crown areas of the outer cylinders being in a specific ratio to the piston crown area of the middle cylinder depending on the selected mode of control, and means to protect against buckling comprising the piston rods of the outer cylinders being rigidly interconnected and guide rods extending from said outer cylinders slidingly interconnected with the piston rod of the middle cylinder.

4. In a forging manipulator including a manipulator truck, a gripper support, a front suspension link and a rear suspension link which pivotably support the gripper support for relative longitudinal movement on the truck, and hydraulic cylinder means mounted to act between the truck and the gripper support for providing cushioning for longitudinal relative movement of said gripper support with respect to said truck, the improvement wherein the hydraulic cylinder means comprises a double acting movable assembly of three parallel spaced cylinders to form said assembly with a middle and two outer cylinders, respective pistons slidable in said cylinders, and respective piston rods connected to said pistons, means to interconnect the piston rods of said two outer cylinders, means to pivotably connect said interconnecting means to one of the truck and the gripper support, and means to connect the piston rod of said middle cylinder pivotably to the other of the truck and the gripper support comprising a cross-member provided on the piston rod of the middle cylinder, and guide rods extending longitudinally from said outer cylinders and in sliding and guiding engagement with said cross-member.

5. A forging manipulator according to claim 4 wherein said interconnecting means comprises a cross-member secured to and interconnecting said outer cylinder piston rods.

6. In a forging manipulator including a manipulator truck, a gripper support, a front suspension link and a rear suspension link which pivotably support the gripper support for relative longitudinal movement on the truck, and hydraulic cylinder means mounted to act between the truck and the gripper support for providing cushioning for longitudinal relative movement of said gripper support with respect to said truck, the improvement wherein the hydraulic cylinder means comprises a double acting movable assembly of three parallel spaced cylinders to form said assembly with a middle and two outer cylinders, respective pistons slidable in said cylinders, and respective piston rods connected to said pistons, a cross-member secured to and interconnecting the piston rods of said two outer cylinders, means to pivotably connect said cross-member to one of the truck and the gripper support, and means to connect the piston rod of said middle cylinder pivotably to the other of the truck and the gripper support.

* * * * *